United States Patent [19]

Scott

[11] 4,193,161

[45] Mar. 18, 1980

[54] VACUUM APPARATUS WITH TILTING CONTAINER

[75] Inventor: Robert G. Scott, Lemont, Ill.

[73] Assignee: American Cleaning Equipment Corporation of Illinois, Addison, Ill.

[21] Appl. No.: 963,316

[22] Filed: Nov. 24, 1978

[51] Int. Cl.[2] ..... A47L 9/00

[52] U.S. Cl. ..... 15/352; 15/353; 15/410; 248/129; 248/137

[58] Field of Search ..... 15/352, 353, 410; 248/128, 129, 130, 133, 137, 138, 139, 141, 140, 142; 280/47.17, 47.24, 47.26

[56] References Cited

U.S. PATENT DOCUMENTS

| | | | |
|---|---|---|---|
| 763,855 | 6/1904 | Charlebois | 248/141 X |
| 1,220,640 | 3/1917 | Kelly . | |
| 1,559,792 | 11/1925 | Seabold | 248/141 X |
| 2,043,896 | 6/1936 | Larsen et al. | 248/141 X |
| 3,063,082 | 11/1962 | Rosenberg . | |
| 3,290,716 | 12/1966 | Cain | 15/320 X |
| 3,930,630 | 1/1976 | Wulff | 248/129 |
| 3,942,217 | 3/1976 | Bates | 15/352 X |

*Primary Examiner*—Christopher K. Moore
*Attorney, Agent, or Firm*—Emrich, Root, O'Keefe & Lee

[57] ABSTRACT

The apparatus includes a rimmed base having support wheels. A pair of supports extend upwardly from the base; and a handle is pivotally connected to the uprights for movement between a use position in which the handle may be used for pushing the apparatus, and a dumping position in which the handle is rotated approximately 180° about a horizontal axis to lift the container and disengage it from the base to a raised position in which it is free to be rotated for dumping the contents of the container. The handle includes a pair of depending extension members pivotally connected to the container at approximately the vertical and horizontal midpoints of the container to facilitate emptying the contents.

4 Claims, 5 Drawing Figures

Fig. 1
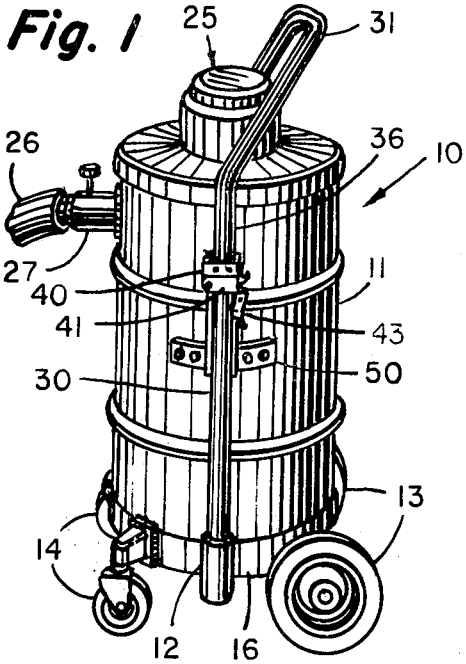
Fig. 2
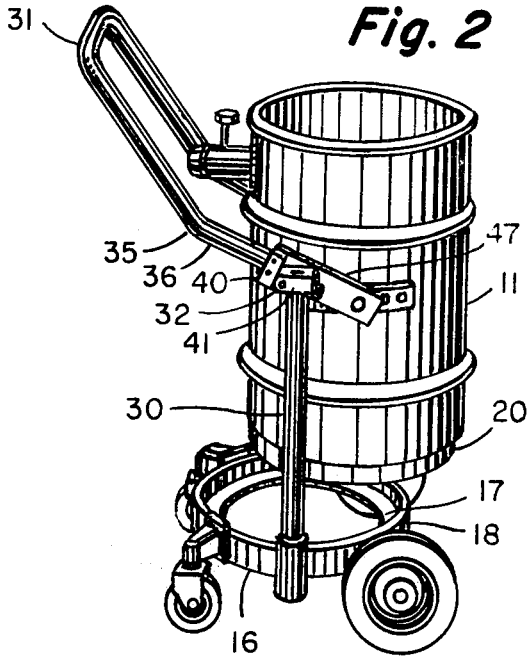
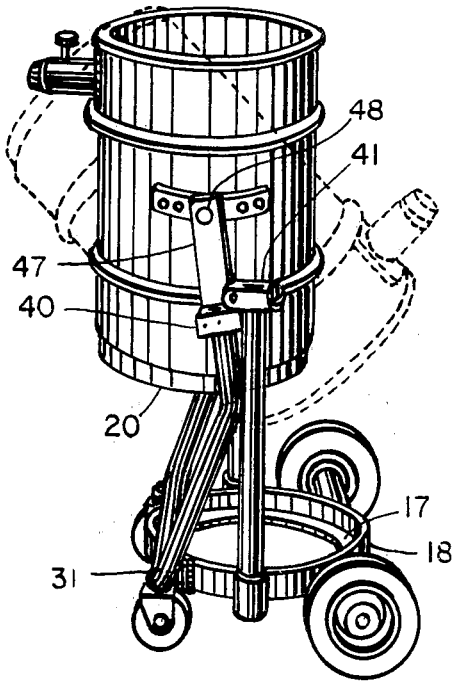
Fig. 3
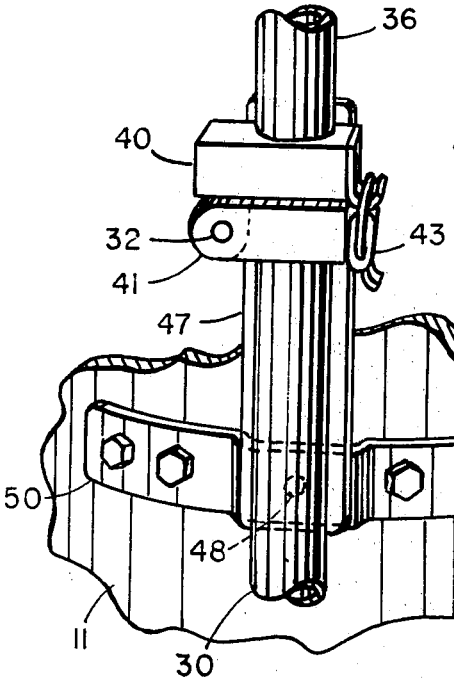
Fig. 4
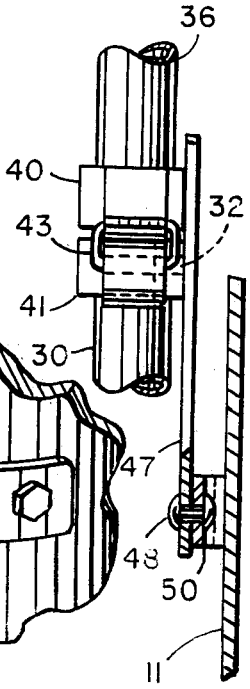
Fig. 5

VACUUM APPARATUS WITH TILTING CONTAINER

BACKGROUND AND SUMMARY

The present invention relates to maintenance apparatus in general; and more particularly, it relates to a vacuum device for vacuuming debris or water and collecting it in a container which may be tilted for disposing of the contents of the container.

The apparatus includes a base in the form of an annular support having an upright peripheral rim for engaging and holding the container during normal operation. Support wheels are mounted to the base for making the apparatus mobile.

A pair of supports extend upwardly from opposite sides from the base; and a handle having a general inverted U-shape is pivotally attached to the upright supports. The handle may be moved between a use position in which the handle extends above and to the rear of the apparatus for pushing it, and a dumping position in which the handle is rotated approximately 180° from the use position. Preferably, the pivotal connections between the handle and the upright supports are offset relative to the axis of the supports so that the weight of the container and its contents is stable in both the use and dumping positions. A latch is provided for locking the handle to the upright supports in the use position.

The handle includes a pair of extension members, one located at either end of the handle, which depend from the handle in the use position to a point below the pivotal connection between the handle and the upright; and the container is pivotally connected to these depending extension members. Thus, when the handle is rotated from the use position to the dumping position, the depending members on the handle act to crank the container in an upward motion, dislodging the bottom of the container from the base, and raising it to an elevated position from which it is easily rotated for dumping.

An important feature of the invention is that the pivotal connections between the handle extensions and the container define a horizontal axis about which the container may be rotated and which is located near the vertical and lateral midpoints of the container. In other words, the axis of rotation of the container is near the center of mass of the contents of the container so that not much effort is required to tilt the container for dumping.

Other features and advantages of the present invention will be apparent to persons skilled in the art from the following detailed description of a preferred embodiment accompanied by the attached drawing wherein identical reference numeral will refer to like parts in the various views.

THE DRAWING

FIG. 1 is a perspective view of a vacuum system incorporating the present invention;

FIG. 2 is a side view of the apparatus of FIG. 1 with the hose and power unit removed, and with the container partially raised;

FIG. 3 is a side view similar to FIG. 2, but with the container fully raised to the dumping position, and shown tilted for dumping in dashed line; and FIGS. 4 and 5 are fragmentary close-up side and rear views respectively of the inner connection between one side support, the handle and the container.

DETAILED DESCRIPTION

Referring first to FIG. 1, reference numeral 10 generally designates a vacuum apparatus including a container 11 in the form of a drum which is carried by a base generally designated 12.

The base 12 includes first and second larger rear wheels 13, and front caster wheels 14 which are conventionally mounted to a ring-shaped support 16. As best seen in FIG. 2, the support 16 inculdes a horizontal flange 17 and an upright rim 18. The bottom of the container 11 rests on the flange 17 and is held in place by the rim 18 which fits into a corresponding recess 20 at the bottom of the container.

A conventional power unit and container cover assembly generally designated 25 is latched to the top of the container 11; and an extension hose 26 is seen in FIG. 1 to be secured to an inlet sleeve 27 mounted near the top of the container 11.

Referring now to FIG. 2 in particular, a pair of upright supports, one of which is designated 30 are mounted to the ring support 16 and extend upwardly therefrom. Although only one side is seen, in the drawing, the other side of the apparatus is similar, as persons skilled in the art will readily appreciate.

When the container is in the use position of FIG. 1, the axis of the upright supports are substantially coplanar with the axis of the container 11, although this is not necessary for operation.

A handle 31 is pivotally connected at 32 to the top of the upright 30, and similarly connected to the upright on the other side of the container, not seen in FIG. 2.

As best seen in FIG. 2, the handle 31 is in the general shape of an inverted U, and is bent at 35 to form end sections 36 which are coaxial with the upright supports in the use position.

The pivotal connection 32 between the handle and the upright 30 is preferably offset from the axes of the upright 30 and the handle portion 36. To accomplish this, the handle portion 36 is provided with a block 40, and the top of the upright 30 is provided with the similar block 41; and the pivotal connection 32 is located to that side of the vertical extension on the upright 30 which is opposite to the direction in which the handle 31 is inclined, as best seen in FIG. 1. The advantages of this arrangement are that it provides a stable connection both in the use position of FIG. 1 and in the dumping position of FIG. 3 because the center of gravity of the container and its contents is laterally offset relative to this pivotally connection in both cases. A latch generally designed 43 is used to secure the block 40 to the block 41 in the use position.

Referring now to FIGS. 2, 3, and 5 an extension link 47 is ridgedly attached to the block 40 of the handle and, in the use position, the extension 47 is aligned with the upright 30 and spaced inwardly thereof. The end of the extension 47 is pivotally connected at 48 to a strap 50 which is secured to the container 11. A similar structure pivotally connects the other side of the handle to a similar extension. It will be observed that the pivotal connections to the container are generally aligned with the axis of the container and, because the handle extensions 47 are used to crank the container from the use position to the dumping position, the pivotal connections to the container may be located closer towards the vertical midpoint of the container than otherwise would be required. Thus, the axis about which the container is rotated for dumping (defined by the pivotal connections 48 to the container) may be located closer to the center of inertia of the container and its contents. This facilitates dumping of the contents of the container (as illustrated in the dashed position of FIG. 3), and it also insures that when the handle is rotated approximately 180° from the use position to the dumping position, that the container and its contents are stable in the position of FIG. 3 even though the bottom of the container is disengaged from the base ring.

The operation of the apparatus will be apparent to persons skilled in the art from the above description, but to summarize it briefly, in order to dump the contents of the container, first the hose 26 and power unit/cover 25 are removed. The apparatus including the container are then wheeled to the basin in which it is desired to dump the contents. The latch 43 is unlocked, and the handle 31 is rotated from the use position of FIG. 1, through the position shown in FIG. 2, to that of FIG. 3 (approximately 180°). The drum may then simply be turned by hand to the dashed position shown in FIG. 3 for dumping.

It will be observed that the initial rotating motion of the handle 31 lifts the drum upright to displace it from its mounting to its base 12. When assembled in the use position, the container is, however, secured by means of the rim 16 to the base 12. Further, when the container and its contents are in the raised position, the container is stable because the block 40 engages the upright 30 and the pivotal connection 48 between the handle extension and the container is located at an over-center position relative to the pivotal connection between the handle 31 and the upright 30. This relationship does not change even though the container is tilted for dumping. In other words, the apparatus remains stable while the contents are being dumped.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In a vacuum apparatus including a container and a power unit removably mounted to the top of the container, the improvement comprising: a base provided with support wheels; support means extending upwardly of said base and defining first and second vertical axes spaced on either side of said container; a handle of generally inverted U-shape and defining lower portions aligned coaxially with said support means and extending upwardly and rearwardly therefrom when said handle is in a use position; first connecting means for pivotally connecting the ends of said handle to said support means at a position laterally offset relative to said axes of said support means while permitting said handle to be rotated between a use position in which said handle extends above said container and a dumping position in which said handle is rotated approximately 180° from said use position; and second connecting means for pivotally connecting said handle to said container at a location below the pivotal connection of said handle to said support means when said handle is in said use position, the pivotal connections between said handle and said container defining a horizontal axis intersecting with the vertical axes of said support means in the use position; whereby the center of gravity of the container and its contents is generally aligned with the axes of said support means in the use position and offset from said pivotal connection between said handle and support means, and said center of gravity is also laterally offset to the other side of said pivotal connection between said handle and said support means in the dumping position.

2. The apparatus of claim 1 wherein said base is ring-shaped and includes a horizontal annular flange for receiving the bottom of said container in an upright peripheral rim extending from said flange, the bottom of said container defining a recess for receiving and securing said rim in the use position.

3. The apparatus of claim 1 wherein said handle defines first and second side extensions depending downwardly from the connection between said handle and said support means for providing said pivotal connection to said container, whereby said extensions act to crank said container from the use position to disengage it from said base and to raise it above said base to the dumping position.

4. The apparatus of claim 3 further comprising latch means for securing said handle to said support means in the use position, whereby said handle may be used to push the apparatus without rotating said handle.

* * * * *